US008073181B2

(12) United States Patent
Bakalos et al.

(10) Patent No.: US 8,073,181 B2
(45) Date of Patent: Dec. 6, 2011

(54) PASSIVE HEADPHONE EQUALIZING

(75) Inventors: Pericles Nicholas Bakalos, Maynard, MA (US); Roman Sapiejewski, Boston, MA (US); Jason M. Harlow, Watertown, MA (US)

(73) Assignee: Bose Corporation, Framingham, MA (US)

( * ) Notice: Subject to any disclaimer, the term of this patent is extended or adjusted under 35 U.S.C. 154(b) by 1272 days.

(21) Appl. No.: 11/616,365

(22) Filed: Dec. 27, 2006

(65) Prior Publication Data

US 2008/0152162 A1 Jun. 26, 2008

Related U.S. Application Data

(63) Continuation-in-part of application No. 11/428,057, filed on Jun. 30, 2006, now Pat. No. 7,916,888.

(51) Int. Cl.
*H04R 25/00* (2006.01)

(52) U.S. Cl. ..... 381/384; 381/103; 381/370

(58) Field of Classification Search ..... 381/98–103, 381/111–117, 370, 384
See application file for complete search history.

(56) References Cited

U.S. PATENT DOCUMENTS

| | | | |
|---|---|---|---|
| 1,893,474 | A | 1/1933 | Lieber |
| 4,058,688 | A | 11/1977 | Nishimura et al. |
| 4,677,679 | A | 6/1987 | Killion |
| 4,870,688 | A | 9/1989 | Voroba et al. |
| 4,878,560 | A | 11/1989 | Scott |
| 4,880,076 | A | 11/1989 | Ahlberg et al. |
| 4,917,504 | A | 4/1990 | Scott et al. |
| 5,327,507 | A | 7/1994 | Suzuki |
| 5,712,453 | A | 1/1998 | Bungardt et al. |
| 5,761,298 | A | 6/1998 | Davis et al. |
| 5,781,638 | A | 7/1998 | Hosaka et al. |
| 5,887,070 | A | 3/1999 | Iseberg et al. |
| 6,021,195 | A | 2/2000 | Brawne et al. |
| RE37,398 | E | 10/2001 | Nageno |
| 6,320,960 | B1 | 11/2001 | Lathrop, III et al. |
| D478,991 | S | 8/2003 | Dyer et al. |
| RE38,351 | E | 12/2003 | Iseberg et al. |
| 6,688,421 | B2 | 2/2004 | Dyer et al. |
| 6,735,316 | B1 | 5/2004 | Wurtz |
| 6,831,984 | B2 | 12/2004 | Sapiejewski |
| 6,922,476 | B2 | 7/2005 | Nassimi |
| 2001/0043707 | A1 | 11/2001 | Leedom |
| 2003/0152244 | A1 | 8/2003 | Dobras et al. |
| 2004/0042625 | A1 | 3/2004 | Brown |
| 2005/0147269 | A1 | 7/2005 | Oliveira et al. |

FOREIGN PATENT DOCUMENTS

| | | | |
|---|---|---|---|
| EP | 0825796 | A2 | 2/1998 |
| EP | 1058479 | A2 | 12/2000 |
| EP | 1809069 | A1 | 7/2007 |
| WO | 9931935 | A1 | 6/1999 |
| WO | 0124579 | | 4/2001 |
| WO | 03069951 | | 8/2003 |
| WO | 2007031340 | A2 | 3/2007 |
| WO | 2007089845 | A2 | 8/2007 |

OTHER PUBLICATIONS

Office Action dated Dec. 21, 2009 for EP 07111157.9-1224.
EP Search Report dated Dec. 10, 2008 for EP Appl. No. 07111157.9-1224 / 1874080.

(Continued)

*Primary Examiner* — Suhan Ni

(57) ABSTRACT

An electrical equalization module that is second order or higher. The equalization module is used to achieve a desired frequency response for audio headphones. The equalization module includes capacitors or inductors. The equalization module is a bridged-T circuit, parallel RLC circuit, or series RLC circuit.

17 Claims, 5 Drawing Sheets

OTHER PUBLICATIONS htlp://www.sonystyle.com/isbinIINTERSHOP.enfinity/eCS/Store/en/-/USD/SY__DisplayProductInformatIonStartCategoryName=pa__Headphones-FontopiaEarbud&ProductSKU=MDRED21LP&TabName=specs&var2=, Sony MDR ED21LP.

http://emedia.leeward.hawaii.edu/Frary/sony__mdr-nc1 0__review.htm, SonyMDR-NC10 Noise Canceling Stereo Headphones.

hltp://www.plantronics.com/media/media__resources/literature/user__guides/discovery640__ug__an__e.pdf;jsessionid=XIFCOZVIKEJBOCQBGNUCFFAKAEZWSIVO, Plantronics Discovery 640 User Guide Printed Jun. 2005, pp. 1-18.

http://www.plantronics.com/media/media__resources/literature/cordless__mobile/discovery640__en.pdf;jsessionid=XIFCOZVIKEJBOCQBGNUCFFAKAEZWSIVO, Plantronics Discovery 640 Bluetooth Headset.

http://www.shure.com/PersonalAudio/Products/Earphones/ESeries/us__pa__E500__pth__content, E500PTH Sound Isolating Earphones, Triple Hi-Definition Drivers.

International Search Report and Written Opinion dated Jun. 18, 2008 from International Application No. PCT/US2007/088805.

International Report on Patentability dated Jul. 9, 2009 for PCT/US2007/088805.

PASSIVE HEADPHONE EQUALIZING

BACKGROUND

This application is a continuation-in-part of U.S. patent application Ser. No. 11/428,057, filed Jun. 30, 2006 now U.S. Pat. No. 7,916,888. Headphones are sound reproduction devices worn on the listener's head. Equalization refers to electrical or physical means to modify the audible frequency response of the headphones to achieve a desired frequency response. Electrical equalization may be either active or passive. Active equalization uses complex circuitry such as integrated circuits that require an external power source. Passive equalization uses only simple circuit elements such as resistors, capacitors, and inductors, and does not require a separate power source.

SUMMARY

In General, in one aspect, an audio device includes a headphone driver; a mechanical housing adapted for use with the headphone driver; and an electrical equalization module adapted for use with the headphone driver and the mechanical housing. In some examples, the electrical equalization module includes an equalization circuit of at least second order.

Implementation may include one or more of the following features. The electrical equalization module may include an inductor, and the inductance may be less than 5 millihenries or may be less than 1 millihenry. The electrical equalization module may include a capacitor. The electrical equalization module may include two capacitors that are not connected in a simple series or simple parallel configuration. The electrical equalization module may include a bridged-T circuit. The bridged-T circuit may be electrically connected in series with the headphone driver. The electrical equalization module may include a capacitor and an inductor. The capacitor and inductor may be electrically connected to make a parallel combination. The parallel combination of inductor and capacitor may be electrically connected in series with the headphone driver. The inductor and capacitor may be electrically connected to make a series combination. The series combination of inductor and capacitor may be electrically connected in parallel with the headphone driver. The headphone driver and the mechanical housing may be configured for use as an in-ear headphone.

In general, in one aspect, an audio device includes a headphone driver; a mechanical housing configured for the headphone driver; and an electrical equalization module configured for the headphone driver and the mechanical housing. The equalization module has a frequency response with a notch shape. The notch shape may have a depth of greater than 3 dB relative to the response level at low frequencies or relative to the response level at high frequencies. The notch shape may have a center frequency in the range of 0.25 kHz to 10.

DETAILED DESCRIPTION

Figure 1:
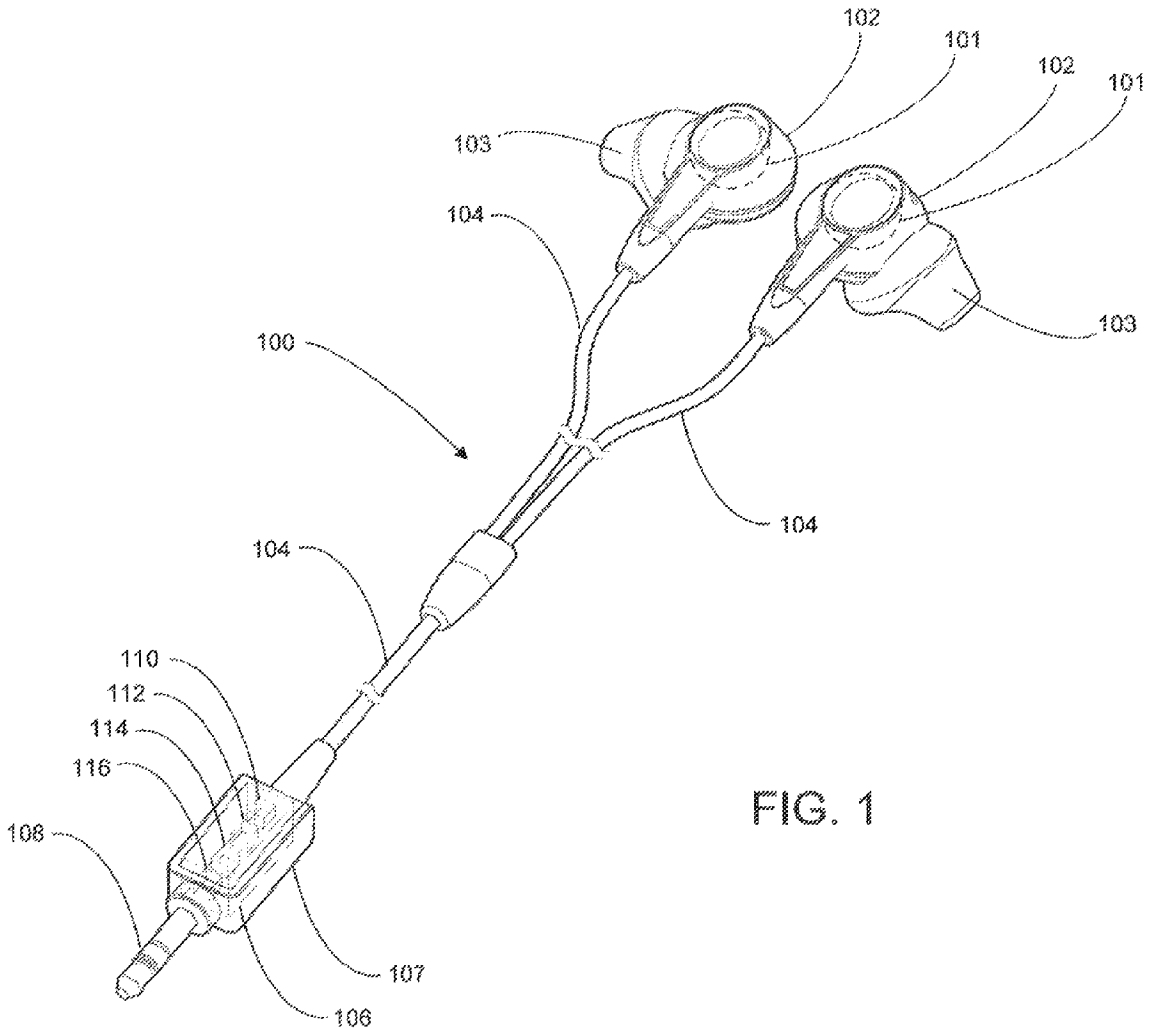
FIG. 1 is a drawing of a headphone assembly.

Referring to FIG. 1, there is shown a drawing of a headphone assembly 100. Headphone assembly 100 includes headphone drivers 101 that are contained within mechanical housings 102. Sound is radiated out through eartips 103 to the user's ears. The headphone assembly 100 also includes electrical cord 104, equalization module 106, connector housing 107, electrical circuit elements 110, 112, 114, and 116, and electrical plug 108. Electrical circuit elements 110, 112, 114, and 116 are located inside equalization module 106, and equalization module 106 may be contained within connector housing 107. The electrical circuit elements 110, 112, 114, and 116 may be resistors, capacitors, inductors or other commonly available electrical circuit elements. The electrical circuit elements 110, 112, 114, and 116 are electrically coupled to each other, the electrical cord 104, and the electrical plug 108. The electrical cord 104 is electrically connected to headphone drivers 101. Mechanical housings 102 support the headphone drivers 101. Tips 103 are optionally fitted over mechanical housings 102 and improve comfort when the headphones assembly 100 are used by a listener.

The operation of headphone assembly 100 is as follows. An electrical audio signal from a source device such as a CD or MP3 player is connected to the electrical plug 108. The electrical signal is then equalized by the equalization module 106 which includes a number of electrical circuit elements such as 110, 112, 114, and 116. The electrical circuit elements 110, 112, 114, and 116 make up an equalization circuit which is shown in more detail in FIG. 2. The equalized electrical signal is coupled to headphone drivers 101 by electrical cord 104. The headphone drivers 101 are electromechanical devices that convert the equalized electrical audio signal into sound. Tips 103 couple the sound output from headphone drivers 101 to a user's ears. The sound from headphone drivers 101 may be modified by the acoustic properties of the mechanical housing 102 and the tip 103.

Each headphone driver 101 has an equalization module 106. In some embodiments, there may be only one headphone driver 101 which is intended to be used in only one car. FIG. 1 shows a headphone assembly 100 that fits in the ear, but in some embodiments the headphone assembly 10 may fit over the entire ear or may fit on the ear.

The equalization module 106 contains electrical circuit elements that make up an electrical filter circuit. Electrical filter circuits can generally be categorized by the number of reactive components, which is related to the filter order. Capacitors and inductors are reactive components, but resistors are not reactive components. Multiple reactive components of the same type that are electrically connected in a simple series or simple parallel configuration can be combined into a single equivalent reactive component. The number of poles are zeros in the transfer function typically defines the order of the filter circuit, which in most cases is equal to the number of reactive components used in the filter circuit. A filter circuit with one reactive component is considered first order; a filter with two reactive components is second order; and so on.

First order filter circuits are limited in the frequency response shapes that can be realized. When used with a headset, and in particular an in-ear headset with a complex mechanical structure such as the Bose® In-Ear headphones, the desired equalization may be more complex than can be realized with a simple first order filter. If no external power source is present, the filter must be passive. Passive filter circuits must be designed taking into account both the load impedance of the filter and the source impedance, if a desired frequency response is to be realized. Passive filter circuits of second order or higher (compared to first order circuits) may require components with increased physical size and weight, and may have increased sensitivity to the output impedance of the source circuit.

Figures 2A, 2B, 2C:
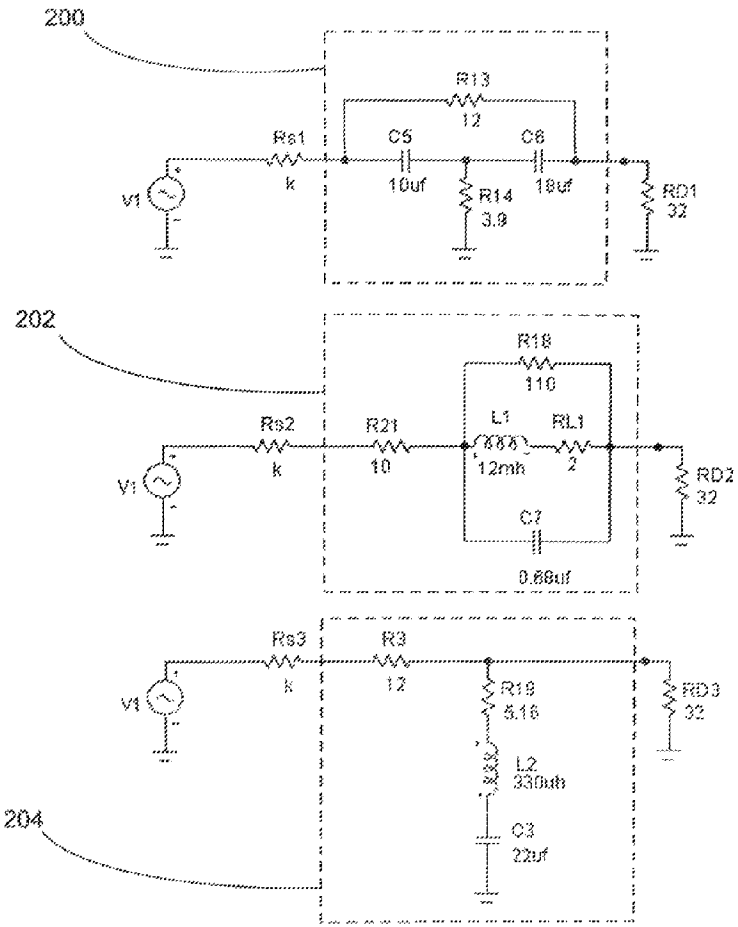
FIG. 2 is a circuit schematic of three equalization modules.

Referring to FIGS. 2A-C, there are shown electrical schematics of three embodiments of electrical equalization module 106. All three embodiments shown are second order passive electrical circuits. These modules are intended to be contained within the headphones assembly 100 and are used to modify the audible frequency response of the headphones assembly 100. The first embodiment shown in FIG. 2A incorporates a bridged-T circuit 200, which includes two capacitors C5 and C6 and two resistors R13 and R14, connected so resistor R13 bridges across the "T" shape formed by the two capacitors and resistor R14. The second embodiment shown in FIG. 2B incorporates a parallel RLC circuit 202, which includes resistor R18, inductor L1 and capacitor C7 that are connected in parallel. Parallel RLC circuit 202 further includes resistor R21 and resistor RL1. The third embodiment of equalization module 106 is shown in FIG. 2C and incorporates series RLC circuit 204, which includes resistor R19, inductor L2, and capacitor C3 which are connected in series. The series combination of inductor L2 and capacitor C3 are electrically connected in parallel with the headphone driver. Series RLC circuit 204 also includes resistor R3. FIGS. 2A-C also show resistors Rs1, Rs2, and Rs3 which represent the output resistance of the source device, V1 which represents the driving voltage of the source signal, and RD1, RD2, and RD3 which represent the impedance of the headphone driver 101. Depending on the source device, the source output resistance can vary over a wide range. In some embodiments, a low source output impedance may be 5 ohms and a high source output impedance may be 75 ohms.

Size and weight are important parameters of the equalization module 106 when the equalization module 106 must be incorporated into a small and light structure such as an electrical connector or headphones that are carried in the ear or on the head. Active equalization modules require a separate power source which may be large and difficult to locate within the equalization module or the headphones. For the case of second order filters, passive equalization may be accomplished in a smaller physical space than active equalization, when the power supply is taken into account. For higher order filters, at some point active equalization will be smaller and lighter than passive equalization. The point at which the trade off occurs depends on the frequency range of the equalization, the amount of power needed, etc. In general, audio frequency filters greater than fourth order will be smaller and lighter when realized as active equalization, and filters of second order or less will be smaller when realized as passive filters.

Figure 3:
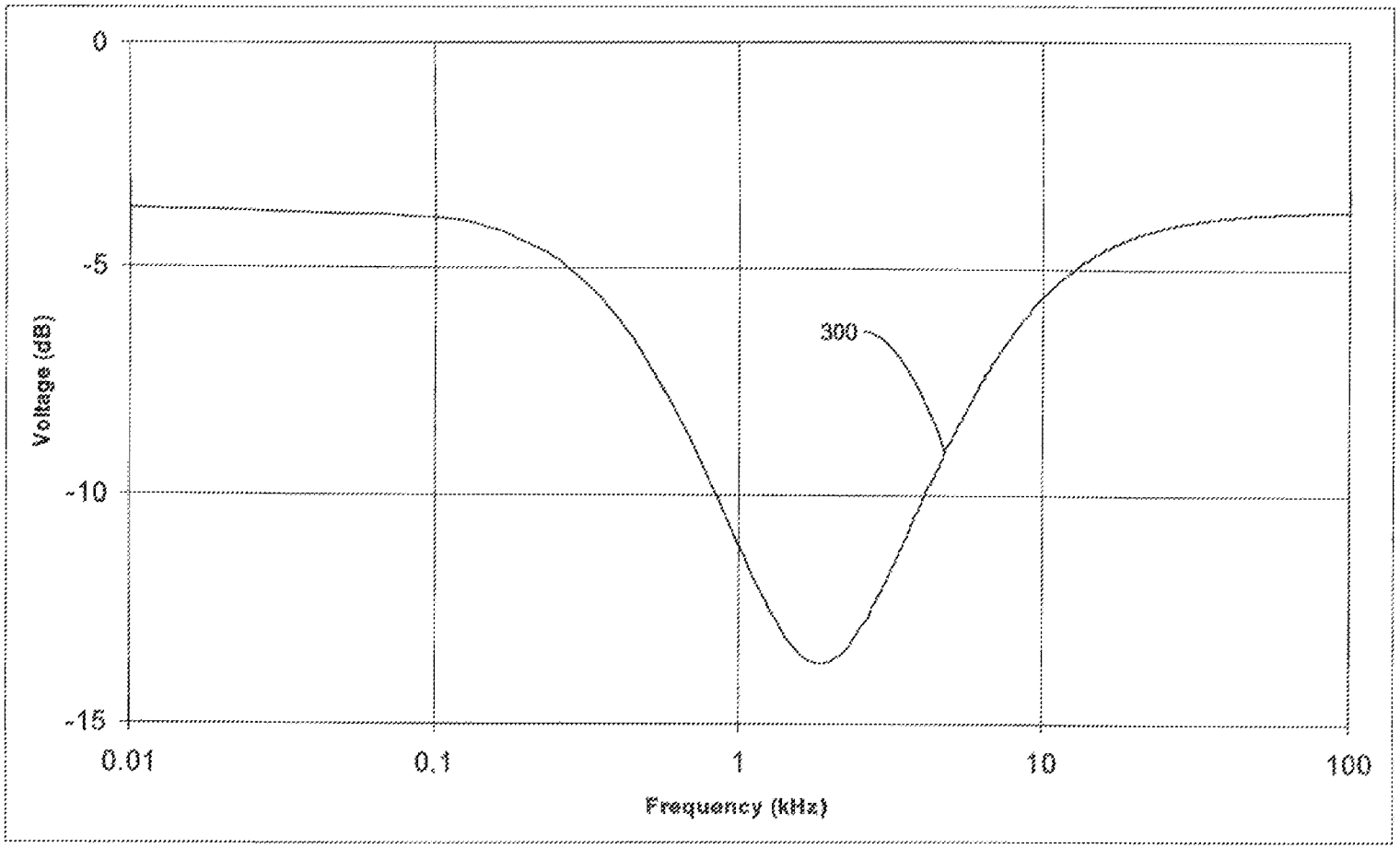
FIG. 3 is a graph of a target curve for equalization.

Referring to FIG. 3, there is shown a graph of an example target curve 300 for equalization module 106. The target curve displays a notch shape that occurs over a range of frequencies from 0.1 kHz to 10 kHz and is centered at approximately 1 to 2 kHz. A notch shape with a depth greater than 3 dB is a common equalization target curve that is often desired in audio devices. The notch shape in FIG. 3 has a depth of approximately 10 dB measured from the response level at low frequencies. The depth may also be measured from the response level at high frequencies. Depending on the desired target curve, the equalization circuit elements may be designed to make the center frequency of the notch shape occur in the range of 0.25 kHz to 10 kHz. Target curve 300 was empirically derived to work with the Bose® In Ear headphones. The frequency response of the target curve equalization, when combined with the frequency response of the rest of the headphone assembly, results in a desired overall performance characteristic.

Referring again to FIGS. 2A-C, three alternative circuit topologies are shown for realizing the target response curve of FIG. 3. Also shown in the schematic diagrams are the component values required in the different topologies to realize the target. It can be seen that the circuits of FIGS. 2B and 2C use inductors. The inductor in FIG. 2C has a substantially smaller inductance than the inductor in FIG. 2B. A smaller inductance corresponds to a physically smaller and lighter inductor, which has the advantage of fitting easily into headphones of various types including over-the-ear, in-ear, or on-the-ear. In addition to choice of circuit topology, the center frequency of the desired notch and the desired notch depth affects the values of the circuit elements in equalization module 106. For example, if the center of the notch frequency were desired to be at 10 kHz instead of 1 kHz, the component values required would be substantially smaller.

Figure 4:
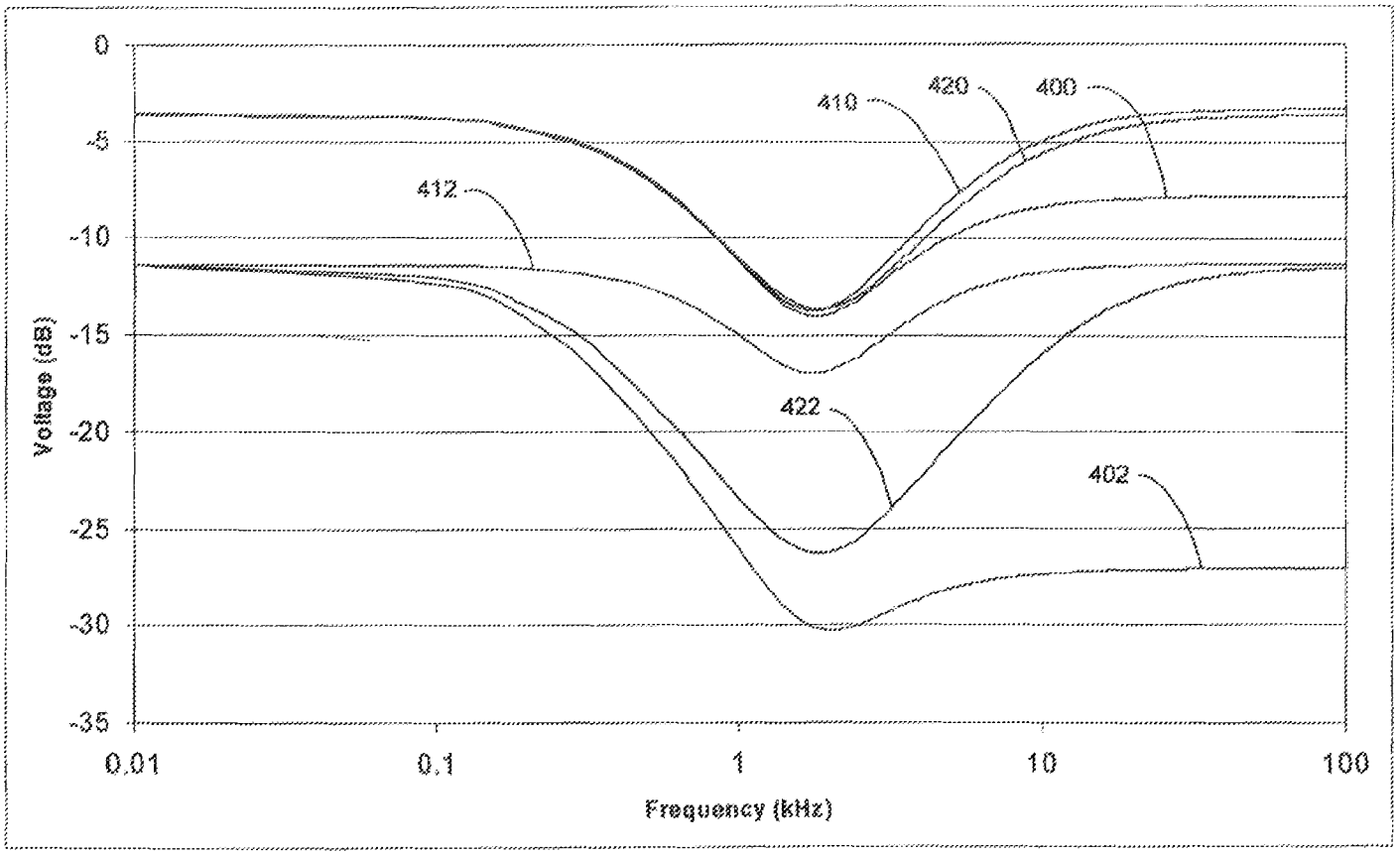
FIG. 4 is a graph of the frequency response of the three equalization modules.

Referring to FIG. 4, there are shown frequency response curves (voltage in dB vs. frequency on a log scale) representing the transfer functions of the three embodiments of equalization modules 106 shown in FIG. 2. These frequency response curves are calculated from a model where the drivers are represented by resistive elements RD1, RD2, and RD3 as shown in FIG. 2. The inductive and capacitive components of the driver impedance are considered negligible at audio frequencies in this model. The bank electromotive force of the driver is also considered negligible. Curves 400 and 402 show the frequency response of bridged-T circuit 200. Curve 400 assumes a source resistance of 5 ohms and curve 402 assumes a source resistance of 75 ohms. Curves 410 and 412 show the frequency response of parallel RLC circuit 202. Curve 410 is assumes source resistance of 5 ohms and curve 412 is for a source resistance of 75 ohms. Curves 420 and 422 show the frequency response of series RLC circuit 204. Curve 420 assumes a source resistance of 5 ohms and curve 422 assumes a source resistance of 75 ohms.

Figure 5:
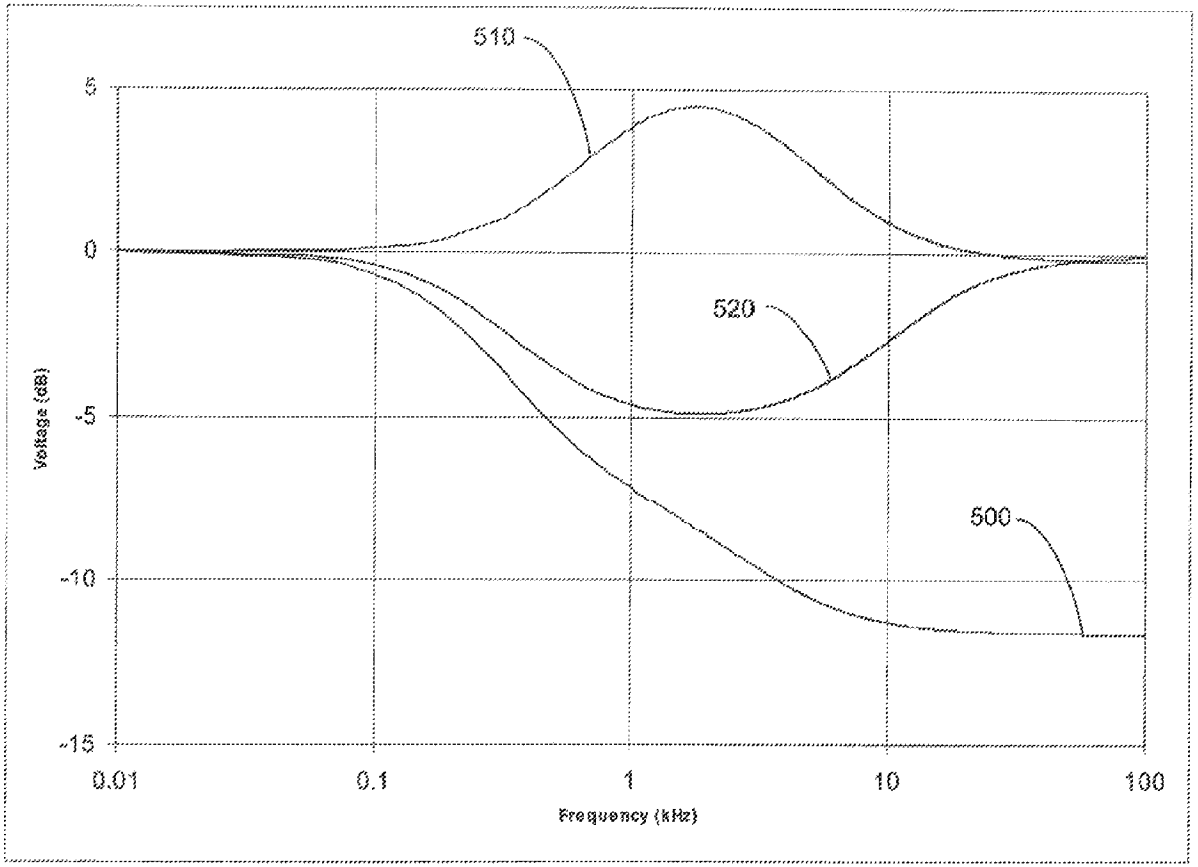
FIG. 5 is a graph of difference curve of the three equalization modules.

It is desirable for the transfer function of an equalization module to maintain the same frequency response over a variety of source impedances. Maintaining frequency response shape reduces perceived variations in sound quality when headphones with equalization are used with devices of varying source impedance. Referring to FIG. 5, there is shown a set of difference curves that compare the curves shown in FIG. 4. Since the vertical axis is a logarithmic scale in dB, ratios of the values in FIG. 4 are used to obtain the difference curves in FIG. 5. The curves in FIG. 5 are normalized so that low frequencies are set to zero dB on the vertical scale. Curve 500 represents the difference between curves 400 and 402 for the bridged-T circuit; curve 510 represents the difference between curves 410 and 412 for the parallel RLC circuit; and curve 520 represents the difference between curves 420 and 422 for the series RLC circuit. The bridged-T circuit curve 500 shows a drop off of approximately 12 dB at high frequencies when comparing low and high impedance sources, the parallel RLC circuit curve 510 shows a peak with a height of approximately 5 dB when comparing low and high impedance sources, and the series RLC circuit curve 520 shows a notch with a depth of approximately 5 dB when comparing low and high impedance sources.

It can be seen that there is substantially more variation in overall response as a function of source impedance for the circuit of FIG. 2 than there is for the circuits of either FIG. 2B or 2C. The circuit of FIG. 2A is beneficial when used in a system where variation in source impedance is small. The circuit of FIG. 2A only uses capacitors, and can be made small and light weight (generally smaller and lighter than a circuit using inductors). The circuits of FIGS. 2B and 2C show approximately the same amount of variation in response as a function of source impedance (although the change is in an opposite direction). Use of inductive components in passive filter circuits allow topologies to be used that have lower sensitivity to source impedance variation than circuit topologies that use only capacitors. Which circuit is preferable in a particular application will depend on which source impedance is expected to be used more often with the headphones employing the equalization. Another consideration will be size, as the inductor used in the circuit topology of FIG. 2C is substantially smaller that the inductor in the circuit of FIG. 2B.

It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. An audio device comprising:

a headphone driver to convert an equalized electrical signal into sound;

a mechanical housing adapted for use with the headphone driver;

a connector housing;

an electrical plug disposed on the connector housing to enable the audio device to be connected to a source device to receive an electrical signal from the source device; and an electrical equalization module adapted for use with the headphone driver and the mechanical housing, wherein:

the electrical equalization module comprises a passive filter circuit comprising a plurality of passive electrical elements that cooperate to equalize the electrical signal, thereby generating the equalized electrical signal; and the electrical equalization module has a frequency response with at least a notch shape.

2. An audio device in accordance with claim 1 wherein the one of the passive electrical elements comprises an inductor.

3. An audio device in accordance with claim 2 wherein an inductance value of the inductor is less than 5 millihenries.

4. An audio device in accordance with claim 2 wherein an inductance of the inductor value is less than 1 millihenry.

5. An audio device in accordance with claim 1 wherein the one of the passive electrical elements comprises a capacitor.

6. An audio device in accordance with claim 1 wherein the the plurality of passive electrical elements comprises two capacitors, the two capacitors not connected in a simple series or simple parallel configuration.

7. An audio device in accordance with claim 1 wherein the passive filter circuit comprises a bridged-T circuit.

8. An audio device in accordance with claim 7 wherein the bridged-T circuit is electrically connected in series with the headphone driver.

9. An audio device in accordance with claim 1 wherein the the plurality of passive electrical elements comprises a capacitor and an inductor.

10. An audio device in accordance with claim 9 wherein the capacitor and inductor are electrically connected to make a parallel combination.

11. An audio device in accordance with claim 10 wherein the parallel combination of inductor and capacitor are electrically connected in series with the headphone driver.

12. An audio device in accordance with claim 9 wherein the inductor and capacitor are electrically connected to make a series combination.

13. An audio device in accordance with claim 12 wherein the series combination of inductor and capacitor are electrically connected in parallel with the headphone driver.

14. An audio device in accordance with claim 1 wherein the headphone driver and the mechanical housing are adapted for use as an in-ear headphone.

15. An audio device in accordance with claim 1 wherein the notch shape has a depth of greater than 3 dB relative to the response level at low frequencies.

16. An audio device in accordance with claim 1 wherein the notch shape has a depth of greater than 3 dB relative to the response level at high frequencies.

17. An audio device in accordance with claim 1 wherein the notch shape has a center frequency in the range of 0.25 kHz to 10 kHz.

* * * * *